US005603211A

United States Patent [19]

Graves

[11] Patent Number: 5,603,211

[45] Date of Patent: Feb. 18, 1997

[54] OUTER SHEAR LAYER SWIRL MIXER FOR A COMBUSTOR

[75] Inventor: Charles B. Graves, Jupiter, Fla.

[73] Assignee: United Technologies Corporation, Hartford, Conn.

[21] Appl. No.: 298,801

[22] Filed: Aug. 31, 1994

Related U.S. Application Data

[63] Continuation-in-part of Ser. No. 99,785, Jul. 30, 1993, abandoned.

[51] Int. Cl.[6] ..... F02C 7/00

[52] U.S. Cl. ..... 60/39.06; 60/39.48

[58] Field of Search ..... 60/732, 733, 748, 60/750, 39.06; 239/405, 399, 406

[56] References Cited

U.S. PATENT DOCUMENTS

| | | | |
|---|---|---|---|
| 2,958,195 | 11/1960 | Dooley | 60/748 |
| 3,576,384 | 4/1971 | Peczeli | 239/405 |
| 3,859,786 | 1/1975 | Azelborn et al. | 60/748 |
| 3,946,552 | 3/1976 | Weinstein et al. | 60/748 |
| 4,260,367 | 4/1981 | Markowski et al. | 60/748 |
| 4,389,848 | 6/1983 | Markowski et al. | 60/750 |
| 4,534,166 | 8/1985 | Kelm et al. | 60/748 |
| 4,845,940 | 7/1989 | Beér | 60/748 |
| 5,165,241 | 11/1992 | Joshi et al. | 60/748 |
| 5,197,290 | 3/1993 | Lee et al. | 60/748 |
| 5,353,599 | 10/1994 | Johnson et al. | 60/748 |
| 5,373,693 | 12/1994 | Zarzalis et al. | 60/748 |

FOREIGN PATENT DOCUMENTS

| | | | |
|---|---|---|---|
| 398488 | 7/1924 | Germany | 239/406 |
| 2198521 | 6/1988 | United Kingdom | 239/406 |

OTHER PUBLICATIONS

Lefebvre, Arthur H., *Gas Turbine Combustion*, McGraw–Hill, pp. 126–135, 1983.

Smith, C. E., Graves, C. B., Roback, R., and Dalessandro, D. D., "Fuel Injector Characterization and Design Methodology to Improve Lean Stability", American Institute of Aeronautics and Astronautics Conference, Jul. 8–10, 1985, AIAA–85–1183.

*Primary Examiner*—Louis J. Casaregola

[57] ABSTRACT

A swirl mixer for a fuel nozzle having a mixing duct comprising a center duct and two annular ducts located radially outward therefrom. Each duct has an air inlet and swirling vanes located adjacent thereto. The outlet of the center duct is located entirely within the annular duct located radially outward therefrom, and the airflows within the ducts have significantly different swirl angles tailored to yield low smoke production and high relight stability in a high temperature rise combustor.

18 Claims, 4 Drawing Sheets

OUTER SHEAR LAYER SWIRL MIXER FOR A COMBUSTOR

This application is a continuation-in-part of U.S. patent application Ser. No. 08/099,785, filed Jul. 30, 1993 (abandoned).

FIELD OF THE INVENTION

The present invention relates to an fuel/air mixer for a combustor, such as the type of combustor used on gas turbine engine, and more specifically, to an fuel/air mixer that uniformly mixes fuel and air so as to reduce smoke produced by combustion of the fuel/air mixture while maintaining or improving the flame relight stability of the combustor.

BACKGROUND OF THE INVENTION

One goal of designers of combustors, such as those used in the gas turbine engines of high performance aircraft, to minimize the amount of smoke and other pollutants produced by the combustion process in the gas turbine engine. For military aircraft in particular, smoke production creates a "signature" which makes high flying aircraft much easier to spot than if no smoke trail is visible. Accordingly, designers seek to design combustors to minimize smoke production.

Another goal of designers of combustors for high performance aircraft is to maximize the "relight stability" of a combustor. The term "relight stability" refers to the ability to initiate the combustion process at high airflows and low pressures after some event has extinguished the combustion process. Poor relight stability can lead to loss of an aircraft and/or a loss of life, depending on the conditions at the time the combustor failed to relight. In the typical combustors in use in gas turbines today, relight stability is directly related to total airflow in the combustor.

As those skilled in the art will readily appreciate, smoke production can be minimized by leaning out the fuel/air mixture in the combustor. Likewise, relight stability can be increased by enriching the fuel/air mixture. Thus, in the past, designers of combustors have faced the problem of having to choose between low smoke production and high relight stability. This problem was addressed by the inventor of the present application and others in a paper entitled "Fuel Injector Characterization and Design Methodology to Improve Lean Stability" which was presented at a conference of the American Institute of Aeronautics and Astronautics in 1985.

What is needed is method and apparatus which reduces smoke production and increases relight stability in the combustor of a gas turbine engine.

SUMMARY OF THE INVENTION

It is therefore an object of the present invention to provide a fuel/air mixer for a combustor of a gas turbine engine which achieves the competing goals of low smoke production and high relight stability.

Another object of the present invention is to provide an air fuel mixer which uniformly mixes fuel and air to minimize smoke formation of when the fuel/air mixture is ignited in the combustor.

Another object of the present invention is to provide a fuel/air mixer which exhibits high relight stability at altitude conditions.

Accordingly, the present invention discloses a fuel/air mixer, and a method for practicing use of the mixer, which includes a first passage having a circular cross-section and two annular passages radially outward therefrom. The annular passages are coaxial with the first passage, and swirlers in the first passage induce sufficiently high swirl into the fuel and air passing therethrough to minimize smoke production in the combustor. Swirlers in the annular passage immediately outward from the first passage induce a swirl into the air passing therethrough which is significantly different from the swirl in the first passage. The first passage discharges into the annular passage immediately outward therefrom, and the relative difference in the swirls of the two airflows reduces the swirl of the resulting airflow yielding a richer recirculation zone for altitude relight stability.

The foregoing and other features and advantages of the present invention will become more apparent from the following description and accompanying drawings.

DETAILED DESCRIPTION OF THE INVENTION

Figure 1:
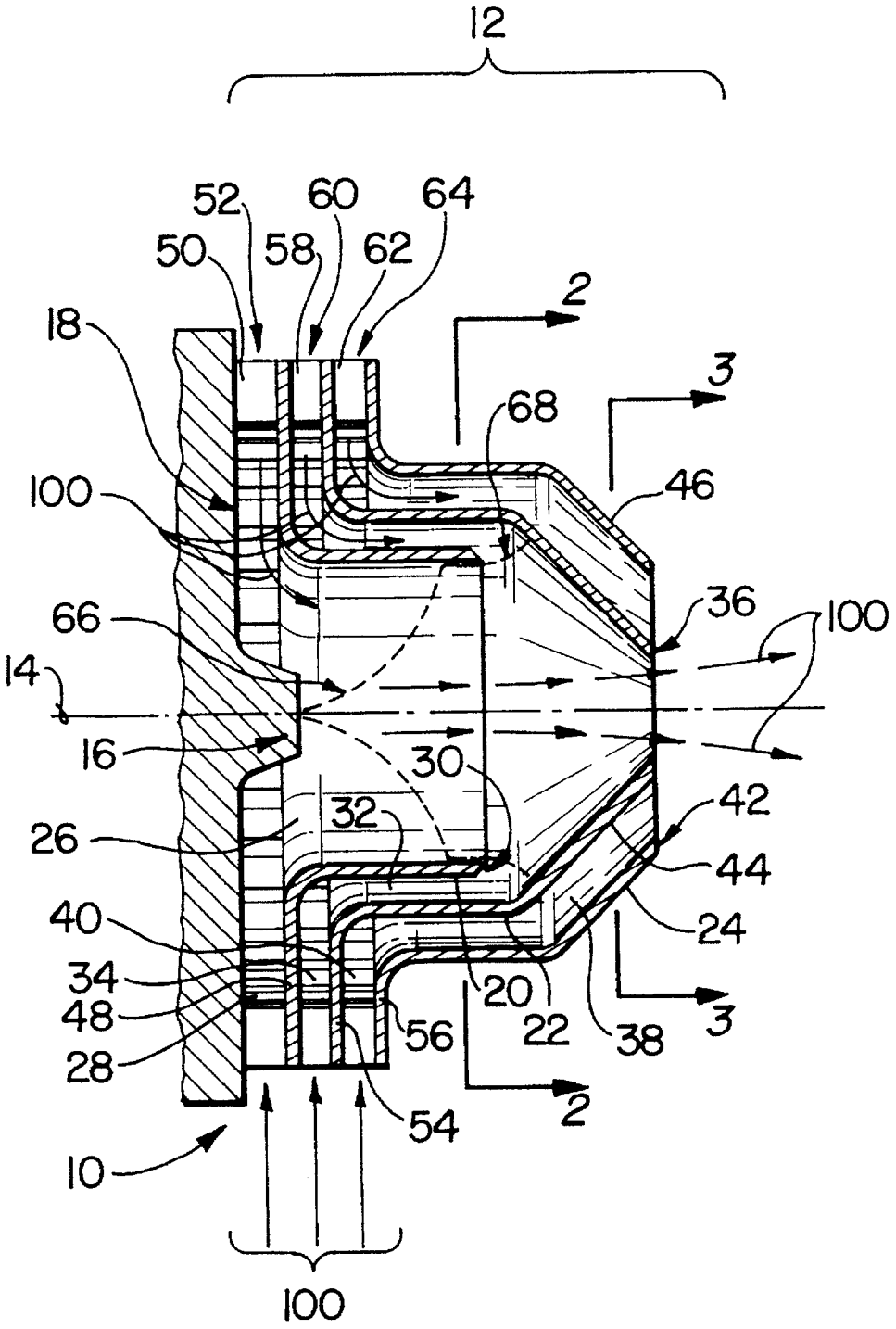
FIG. 1 is a longitudinal sectional view through the preferred embodiment of the fuel nozzle/mixer assembly of the present invention.

The fuel/air mixer 10 of the present invention has a mixing duct 12 which has a longitudinal axis 14 defined therethrough as shown in FIG. 1. A fuel nozzle 16, secured to a mounting plate 18, is located nominally coaxial with the longitudinal axis 14 and upstream of the mixer 10 for introducing fuel thereto as described below. The fuel nozzle 16 may be secured so as to allow shifting to compensate for thermal expansion, and the resultant position of the nozzle 16 after such shifting may not be exactly coaxial. Thus, this invention also allows for the fuel nozzle 16 to be located in radial positions off the centerline 14, or longitudinal axis 14.

The mixing duct 12 preferably includes a first duct 20, a second duct 22 and a third duct 24, each of which is coaxial with the longitudinal axis 14, and is circular in any cross section taken along the that axis 14. It is to be understood that the ducts 20, 22, 24 of the present invention are shown and described herein as cylindrical for the purpose of clarity only. Cylindrical ducts are not intended to be a limitation on the claimed invention, since the ducts could be conically shaped, or any other shape in which sections taken perpendicular to the longitudinal axis yield circular cross-sections. The second duct 22 is spaced radially outward from the first duct 20, and the third duct 24 is spaced radially outward from the second duct 22. The first duct 20 defines a first passage 26 having a first inlet 28 for admitting air 100 into the first passage 26, and a first outlet 30 for discharging air 100 from the first passage 26. The first duct 20 and the second duct 22 define a second passage 32 therebetween which is annular in shape. The second passage 32 has a second inlet 34 for admitting air 100 into the second passage 32 and a second outlet 36 for discharging the air from said second passage 32. The second duct 22 and the third duct 24 define a third passage 38 therebetween which is also annular in shape. The third passage 38 has a third inlet 40 for admitting the air 100 into the third passage and a third outlet 42 for discharging the air 100 from the third passage 38.

The downstream portion of the second duct 22 terminates in a conically shaped prefilmer 44. The first duct 20 terminates short of the prefilmer 44, so that the portion of air exiting the first duct 20 discharges into the conical section 44 of the second duct 22. The outlet 30 of the first duct must be axially spaced from the second outlet 36 a distance at least as great as the radius of the second outlet, for the reason discussed below. The downstream portion of the third duct 24 likewise terminates in a converging section 46, and the second and third outlets 36, 42 are preferably co-planar.

The upstream end of the first duct 20 is integral with a first rim section 48 which is substantially perpendicular to the longitudinal axis 14. The first rim section 48 is in spaced relation to the mounting plate 18, the space therebetween defining the first inlet 28. The swirling vanes 50 of the first swirler 52 span between the first rim 48 and the mounting plate 18, and each vane 50 is preferably integral with the first rim 48 and a sliding surface attachment is used to secure the vanes 50 to the mounting plate 18 to allow for radial movement of the fuel nozzle 16 due to thermal expansion.

The upstream end of the second and third ducts 22,24 are likewise integral with second and third rim sections 54,56, respectively, and each of these rim sections 54,56 is substantially perpendicular to the longitudinal axis 14. The second rim section 54 is in spaced relation to the first rim section 48, the space therebetween defining the second inlet 34, and the third rim section 56 is in spaced relation to the second rim section 54, the space therebetween defining the third inlet 40. The swirling vanes 58 of the second swifter 60 span between the second rim 54 and the first rim 48, and each vane 58 is preferably integral with both adjacent rims 48,54 to fix the relative positions of the first and second ducts 20,22. Likewise, the swirling vanes 62 of the third swifter 64 span between the third rim 56 and the second rim 54, and each vane 62 is preferably integral with both adjacent rims 54,56 to fix the relative positions of the second and third ducts 22,24. Thus, the first passage 26 includes a first swifter 52 adjacent the inlet 28 of the first passage, the second passage 32 includes a second swirler 60 adjacent the inlet 34 of the second passage 32, and the third passage 38 includes a third swifter 64 adjacent the inlet 40 of the third passage 38.

The swirlers 52,60,64 are preferably radial, but they may be axial or some combination of axial and radial. The swirlers 52,60,64 have vanes (shown schematically in FIG. 1) that are symmetrically located about the longitudinal axis 14. The mass of airflow into each passage 26,32,38 is controlled so that available air 100 can be directed as desired through the separate passages 26,32,38. The airflow into each passage 26,32,38 is preferably regulated by determining the desired mass flow for each passage 26,32,38, and then fixing the effective flow area into each passage such that the air 100 is directed into the passages 26,32,38 as desired. Such procedure is well known in the art and is therefor beyond the scope of this invention.

Figure 2:
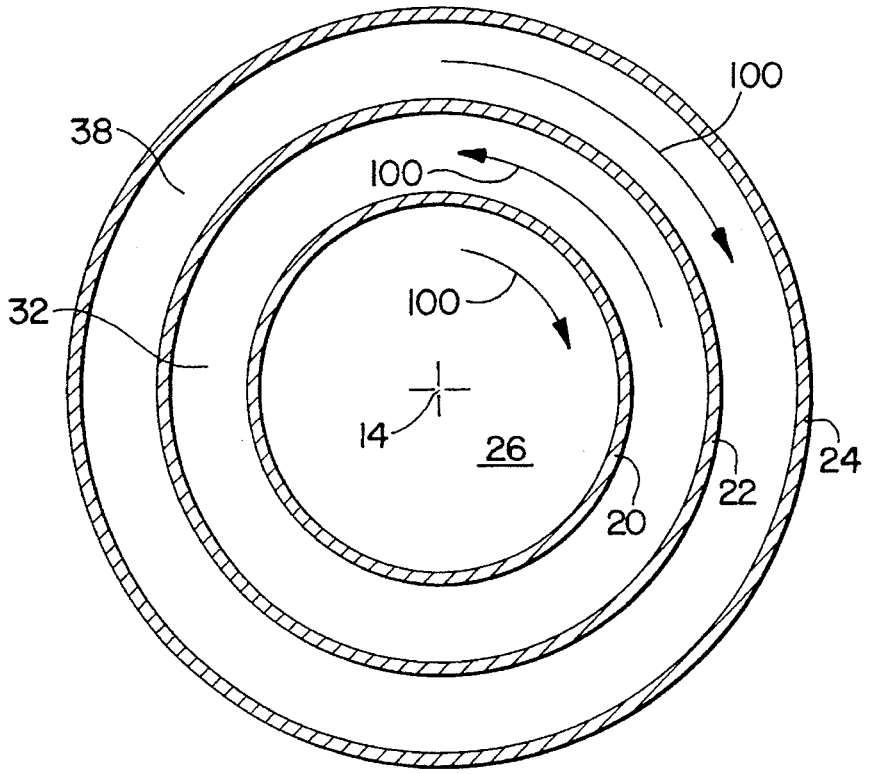
FIG. 2 is a cross-sectional view of a the assembly of FIG. 1 taken along line 2—2 of FIG. 1.

In the preferred embodiment, the first and second swirlers 52,60 are counter-rotating relative to the longitudinal axis 14 (i.e. the vanes 50 of the first swifter 52 are angled so as to produce airflow in the first passage 26 which is counter-rotating relative to the airflow in the second passage 32), as shown in FIG. 2. For the purpose of this disclosure, it is assumed that the fuel nozzle 16 does not impart a swirl to the fuel spray 66, and it is therefore irrelevant which direction the airflows in the first and second passages 26,32 rotate as long as they rotate in opposite directions. However, if the fuel nozzle 16 employed did impart swirl to the fuel spray 66, then the swirl in the first passage 26 should be co-rotational with the fuel spray 66. The vanes 50 of the first swifter 52 are angled so as to produce a swirl angle of at least 50° in the first passage 26, and preferably produce a swirl angle of 55°. This swirl angle is critical to the invention because the inventor has discovered that swirl angles less than 50° in the airflow of the first passage 26 produce significantly higher levels of smoke than swirl angles equal to or greater than 50°. The term "swirl angle" as used herein means the angle derived from the ratio of the tangential velocity of the airflow within a passage to the axial velocity thereof (i.e. swirl angle is the angle whose tangent is equal to the tangential velocity divided by the axial velocity). The swirl angle of an airflow can be analogized to the pitch of threads on a bolt, with the airflow in each passage 26,32,38 tracing out a path along a thread. A low swirl angle would be represented by a bolt having only a few threads per inch, and a high swirl angle would be represented by a bolt having many threads per inch.

The vanes of the second swirler 60 are angled so as to produce a resulting swirl angle of not more than 60° at the confluence 68 of the first and second passages 26,32. Experimental evaluation of the preferred embodiment, where the air mass ratio between the first and second passages 26,32 is in the range of 83:17 to 91:9, has shown that a resulting swirl angle of approximately 50° at the confluence 68 can be obtained by imparting swirl angle in the range of 68° to 75° to the counter-rotating air flowing through the second passage 32. The confluence 68 swirl angle is also critical to the invention because the inventor has discovered that confluence 68 swirl angles greater than 60° yield significantly poorer relight stability than confluence 68 swirl angles of 60° or less. The axial spacing between the first outlet 30 and the second outlet 36 discussed above is necessary to allow establishment of the confluence 68 swirl angle before interaction between the portion of airflow from the third passage 38 and the confluence airflow.

The airflow in the third passage 38 is co-rotating with respect to the airflow in the first passage 26, and the mass of the portion of air flowing through the third passage 38 is no greater than 30% of the sum of the mass of the airflows in the first, second, and third passages 26,32,38, and preferably 15% or less. The vanes 62 of the third swifter 64 are angled so as to produce a resulting swirl angle of approximately 70° in the portion of air flowing through the third passage 38.

In operation, discharge air 100 from a compressor (not shown) is injected into the mixing duct 12 through the swirlers 52,60,64 at the inlets 28,34,40 of the three passages 26,32,38. Of the total airflow injected into the mixing duct, 15% is directed to the third passage 38, and the remaining 85% of airflow, termed "core airflow", is split in the range of 83:17 to 91:9 between the first and second passages 26,32, respectively. The first swifter 52 imparts a 55° swift angle to the air in the first passage 26 in the region of the fuel nozzle 16. The fuel is sprayed 66 into the swirling air, and the fuel and air mix together as they swift down the longitudinal axis 14 to the outlet 30 of the first duct 20. This high first passage swirling centrifuges the fuel droplets outward from the longitudinal axis 14 so that most of the fuel droplets concentrate on the prefilmer 44 of the second duct 22. This centrifuging promotes a hollow cone fuel spray at high fuel flows, which, as those skilled in the art will readily appreciate, reduces smoke. Once the fuel droplets have been concentrated near the prefilmer 44 of the second duct 22, a decrease in swift angle and further mixing of the fuel and air is desirable to enhance the stability of the combustor. As those skilled in the art will readily appreciate, by using a relatively high swirl angle such as 75° in the second passage 32, the desired reduction in first passage swirl angle can be obtained with a minimum amount of second passage 32 airflow. At the first outlet 36, the mixture of fuel and air from the first passage 26 is discharged into the second duct 22 and the counter-rotating airflow from the second passage 32. The turbulence caused by the intense shearing of the first passage 26 airflow and the counter-rotating second passage 32 airflow reduces the overall swirl angle at the confluence 68 of the two airflows and further mixes the fuel and air. As discussed below, the lower core airflow swirl angle downstream of the confluence 68 makes for a richer recirculation zone, which improves relight stability.

Figure 3:
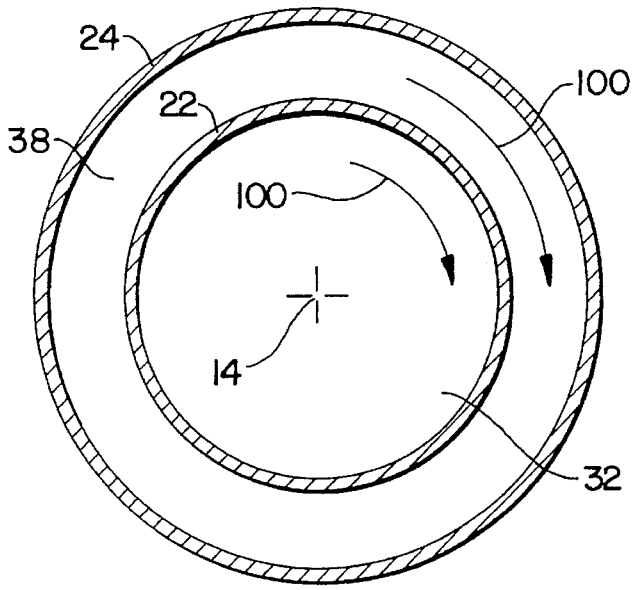
FIG. 3 is a cross-sectional view of a the assembly of FIG. 1 taken along line 3—3 of FIG. 1.
Figure 4:
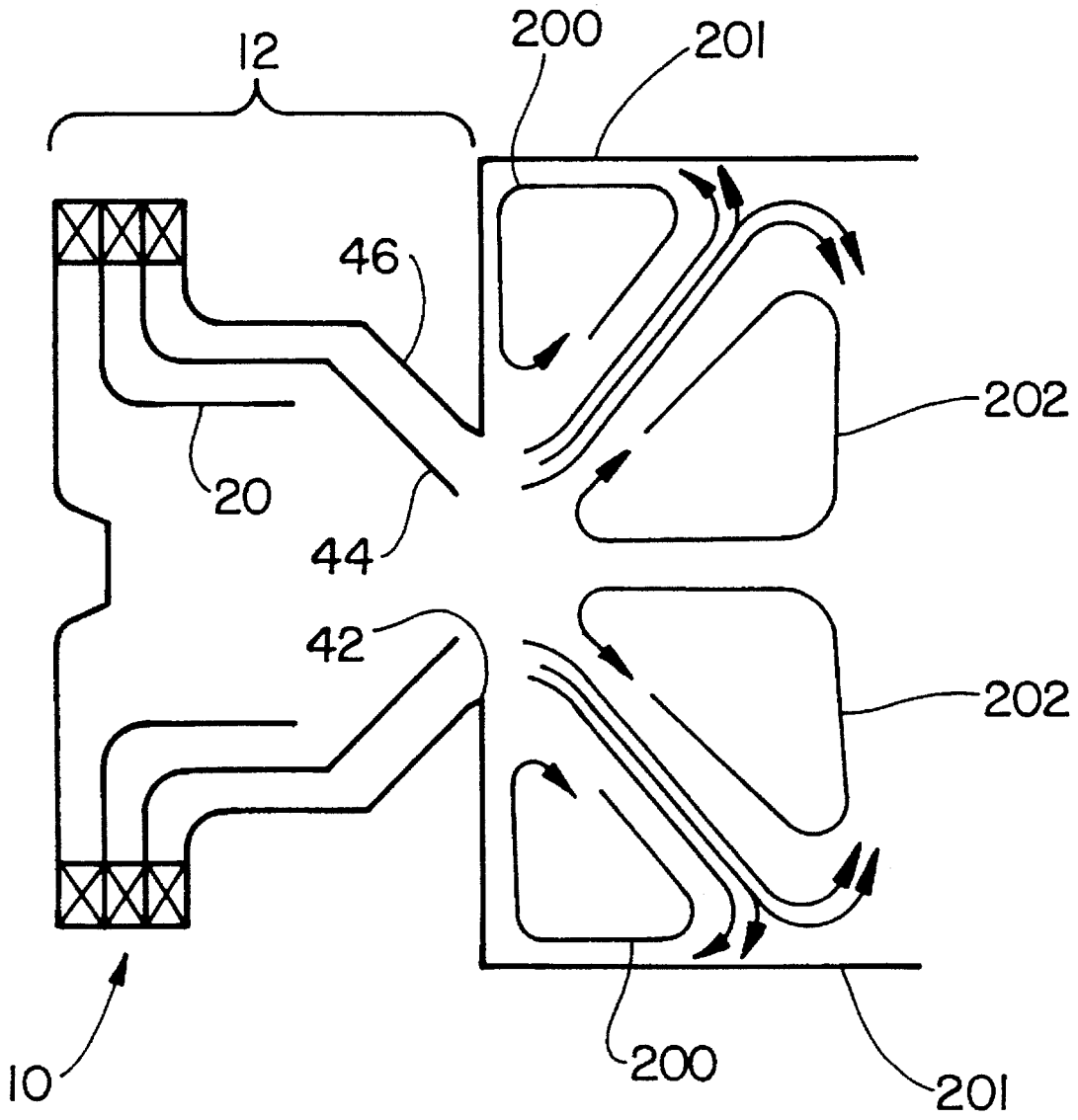
FIG. 4 is a longitudinal sectional view similar to FIG. 1 showing the inner and outer recirculation zones produced by the swirl mixer of the present invention.

Although the swirl angle of the core airflow is reduced immediately downstream of the confluence 68, rotation of the core airflow continues in the same direction as the original first passage 26 airflow, as shown in FIG. 3. As the core airflow exits the prefilmer 44 at a 50° swirl angle, it encounters the third passage 38 airflow which has a swirl angle of 70°. The interaction of the core airflow and third passage airflow creates an outer shear layer, and the vortices produced therein transfer the fuel droplets from the core airflow into the airflow from the third passage. As shown in FIG. 4, this shearing produces a fuel rich outer recirculation zone 200 within the combustor 201 that extends downstream third outlet 42 and is distinctly separate from the inner recirculation zone 202 generated by swirl mixers of the prior art. As discussed above, it is the recirculation zones 200, 202 that increase relight stability, and thus the outer shear layer recirculation zone 200 further enhances the relight stability of the present invention.

The results of experimental testing have shown that the preferred embodiment of the present invention produces a resulting swirl angle immediately downstream of the confluence 68 of approximately 50°, well below the 60° maximum allowable swirl angle for desirable relight stability. When the airflow in the third passage 38 was reduced to 30% of the sum of the mass of the airflows in the first, second, and third passages 26,32,38, an unexpectedly large increase in relight stability was noted. The inventor has discovered that when the high swirl angle flow exiting the third passage 38 encounters the confluence 68 of airflow from the first and second passages 26,32, the substantially greater mass of the core airflow forces most of the third passage airflow to form the outer recirculation zone which is enriched with fuel from the turbulence cause by the difference in swirl angles between the core airflow and the airflow exiting the third passage 38. Consequently, an outer shear layer flame is produced in the combustor which is sustained by third passage 38 airflow and fuel from the core airflow. This outer shear layer flame is important because it decouples relight stability from total airflow. Instead, with the presence of the outer shear layer flame, relight stability becomes a function of the airflow through the third passage 38. Thus, by increasing or decreasing the airflow in the third passage 38 the relight stability can be decreased or increased, respectively, as desired.

Figure 5:
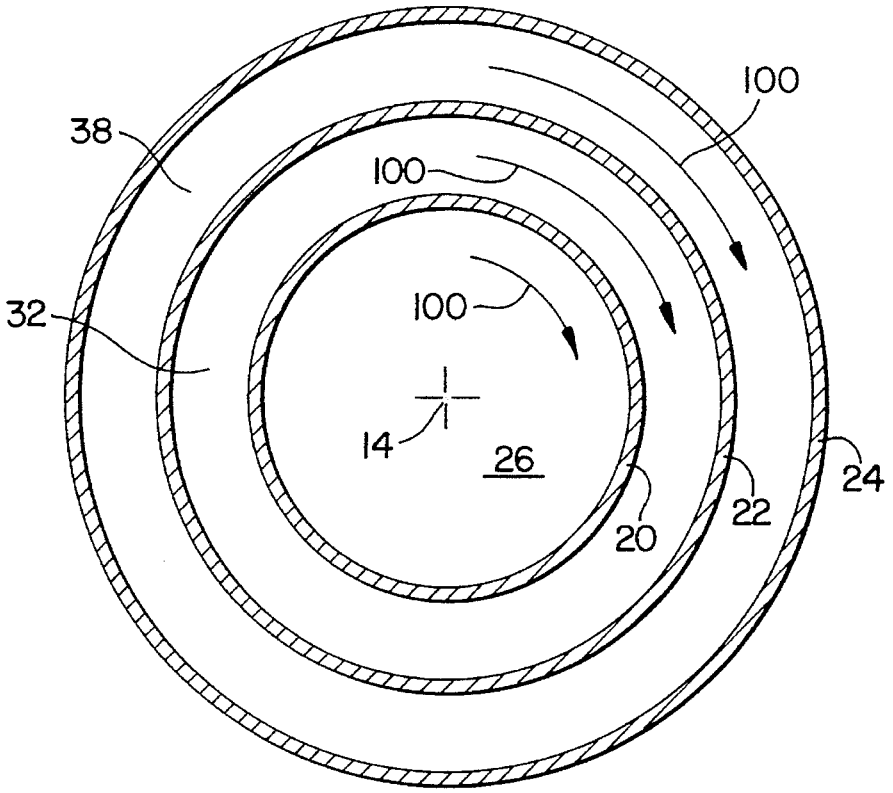
FIG. 5 is a cross-sectional view similar to FIG. 2 for the alternate embodiment of the present invention.

In an alternate embodiment of the present invention, the first and second swirlers 52,60 are co-rotating relative to the longitudinal axis 14 (i.e. the vanes of the first swifter 52 are angled so as to produce airflow in the first passage 26 which is co-rotating relative to the airflow in the second passage 32), as shown in FIG. 5. The vanes 50 of the first swifter 52 are again angled so as to produce a swirl angle of at least 50° in the first passage 26, and preferably produce a swirl angle of from 65° to 75°. The vanes 58 of the second swifter 60 are again angled so as to produce a resulting swirl angle of not more than 60° at the confluence 68 of the first and second passages 26,32. Experimental evaluation of the alternate embodiment, where the air mass ratio between the first and second passages 26,32 is in the range of 9:91 to 17:83, has shown that a resulting swirl angle of approximately 42° at the confluence 68 can be obtained by imparting a 34° swirl angle to the co-rotating air flowing through the second passage 32. The airflow in the third passage 38 is as described for the preferred embodiment.

Figure 6:
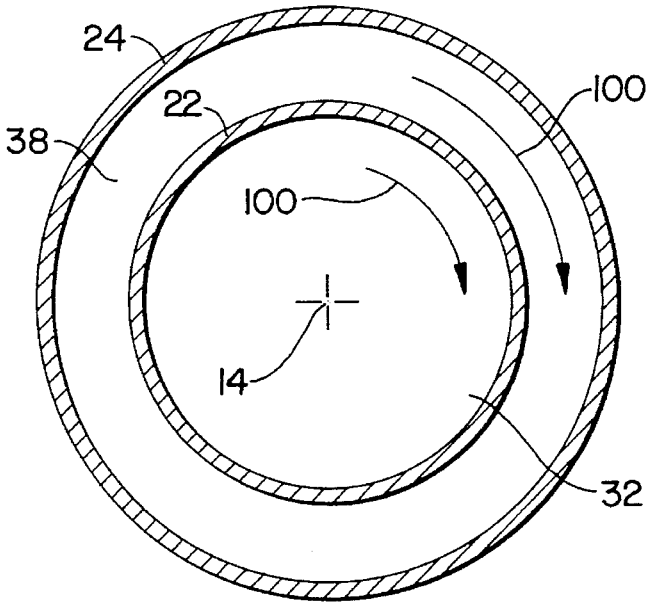
FIG. 6 is a cross-sectional view similar to FIG. 3 for the alternate embodiment of the present invention.

In operation of the alternate embodiment, air 100 from a compressor is injected into the mixing duct 12 through the swirlers 50,60,64 at the inlets 28,34,40 of the three passages 26,32,38. Of the total airflow injected into the mixing duct 12, 15% is directed to the third passage 38, and the remaining 85% of airflow is split in the range of 9:91 to 17:83 between the first and second passages 26,32, respectively. The first swifter 52 imparts a 65° to 75° swirl angle to the air in the first passage 26 in the region of the fuel nozzle 16. The fuel is sprayed 66 into the swirling air, and the fuel and air mix together as they swirl down the longitudinal axis 14 to the outlet 30 of the first duct 20. This high first passage swirling concentrates the fuel adjacent the prefilmer 44 of the second duct 22 and reduces smoke for the reasons discussed above. At the first outlet 30, the mixed fuel and air from the first passage 26 are discharged into the second duct 22 and the co-rotating airflow from the second passage 32. The mismatch between the high swift angle of the first passage 26 airflow and the low swirl angle of the second passage 32, produces shearing at the confluence 68 of the two airflows, and because the mass of the second passage airflow at the lower swift angle is over five times the mass of the higher swift angle first passage airflow, the resulting swift angle immediately downstream of the confluence 68 is approximately 42°, also well below the 60° maximum allowable swirl angle for desirable relight stability. The core airflow continues to rotate in the same direction as the original first passage 26 airflow, as shown in FIG. 6. As the core airflow exits the prefilmer 44 at a 42° swift angle, it encounters the third passage 38 airflow which has a swift angle of 7020 . The interaction of the two airflows produces beneficial results similar to those discussed in connection with the preferred embodiment.

The fuel and air swirl mixer 10 of the present invention retains the high performance qualities of the current high shear designs. The radial inflow swirlers 52,60,64 exhibit the same repeatable, even fuel distribution that exists in current high shear designs. Relight stability responds positively to flow split variations that exist in current high shear designs. Furthermore, the new features of the swift mixer 10 retain the excellent atomization performance of the current high shear designs.

Although this invention has been shown and described with respect to a detailed embodiment thereof, it will be understood by those skilled in the art that various changes in form and detail thereof may be made without departing from the spirit and scope of the claimed invention.

I claim:

1. An fuel/air mixer for mixing fuel and air prior to combustion in a gas turbine engine, said fuel/air mixer comprising:

a mixing duct having a longitudinal axis extending therethrough, an upstream end for receiving said fuel and air and a downstream end for discharging said mixed fuel and air, said mixing duct comprising a first duct having a circular cross-section and defining a first passage, said first passage having a first inlet for admitting a first mass airflow of said air into said first passage, and a first outlet for discharging said air from said first passage;

a second duct coaxial with said first duct, said second duct spaced radially outward from said first duct defining a second passage therebetween, said second passage having a second inlet for admitting a second mass airflow of said air into said second passage, and a second outlet for discharging said air from said second passage;

a third duct coaxial with said second duct, said third duct spaced radially outward from said second duct defining a third passage therebetween, said third passage having a third inlet for admitting a third mass airflow of said air into said third passage, and a third outlet for discharging said air from said third passage;

a fuel nozzle secured to one end of the mixing duct for introducing fuel into said first passage;

means for imparting a first swirl angle to air entering the first passage through the first inlet;

means for imparting a second swirl angle to air entering the second passage through the second inlet; and, means for imparting a third swirl angle to air entering the third passage through the third inlet;

wherein the sum of the first mass airflow and the second mass airflow defines the mass of the core airflow, the first duct discharges into the second duct resulting in a confluence of the air flow from the first and second ducts, the third mass airflow is no greater than 30% of the sum of the first mass, second mass and third mass airflows, the first swirl angle is at least 50°, and the resulting swirl angle immediately downstream of the confluence is not greater than 60°.

2. The fuel/air mixer of claim 1 wherein the second swirl angle is counter-rotating relative to the first swirl angle.

3. The fuel/air mixer of claim 2 wherein the first mass is at least 80% of the mass of the core airflow.

4. The fuel/air mixer of claim 3 wherein the second mass airflow is at least 9% of the mass of the core airflow.

5. The fuel/air mixer of claim 2 wherein the first mass is approximately 91% of the mass of the core airflow, wherein the first swirl angle is approximately 55°.

6. The fuel/air mixer of claim 5 wherein the third swirl angle is approximately 70°.

7. The fuel/air mixer of claim 4 wherein the second swirl angle is at least 60°.

8. The fuel/air mixer of claim 1 wherein the second swirl angle is co-rotating relative to the first swirl angle.

9. The fuel/air mixer of claim 8 wherein the first mass airflow is at least 9% of the mass of the core airflow.

10. The fuel/air mixer of claim 9 wherein the second mass airflow is at least 80% of the mass of the core airflow.

11. The fuel/air mixer of claim 8 wherein the first mass airflow is approximately 15% of the mass of the core airflow, wherein the first swirl angle is approximately 75°.

12. The fuel/air mixer of claim 11 wherein the third swirl angle is approximately 70°.

13. The fuel/air mixer of claim 10 wherein the second swirl angle is not greater than 40°.

14. A method of combusting fuel and air in a combustor to yield minimal smoke production and high flame stability, said method comprising:

providing a first duct having a circular cross-section and defining a first passage, a second duct coaxial with said first duct and a third duct coaxial with said second duct, said second duct spaced radially outward from said first duct defining an annular second passage therebetween, and said third duct spaced radially outward from said second duct defining a third passage therebetween;

spraying fuel into the first duct while swirling a first portion of air into contact therewith at a first swirl angle of at least 50°, thereby mixing the fuel and the first portion of air;

mixing said fuel and first portion of air with a second portion of air at a second swirl angle to produce a confluence of first and second portions, said confluence having a swirl angle of less than 60°;

combining a third portion of air having a mass of no greater than 30% of the sum of the masses of the first, second and third portions to the first and second portions, said third portion co-rotational with said confluence and having a swirl angle of approximately 70°; and, igniting the mixture of said fuel, first and second portions of air.

15. The method of claim 14 wherein the second swirl angle is counter-rotating relative to the first swirl angle.

16. The method of claim 15 wherein the ratio of the mass of the first portion of air to the mass of the second portion of air is approximately 9:1, the first swirl angle is approximately 55°, and the second swirl angle is approximately 75°.

17. The method of claim 14 wherein the second swirl angle is co-rotating relative to the first swirl angle.

18. The method of claim 17 wherein the ratio of the mass of the first portion of air to the mass of the second portion of air is approximately 15:85, the first swirl angle is approximately 75°, and the second swirl angle is approximately 34°.

* * * * *

UNITED STATES PATENT AND TRADEMARK OFFICE

CERTIFICATE OF CORRECTION

PATENT NO. : 5,603,211

DATED : February 18, 1997

INVENTOR(S) : Charles B. Graves

It is certified that error appears in the above-indentified patent and that said Letters Patent is hereby corrected as shown below:

In column 3 at lines 38, 43, 47, and 50, in each instance change "swifter" to --swirler--.

In column 4 at lines 1, 12, 52, and 62, in each instance change "swifter" to --swirler--.

In column 4 at lines 62 and 65, in each instance change "swift" to --swirl--.

In column 5 at line 7, change "swift" to --swirl--.

In column 6 at lines 1, 4, 7, and 24, in each instance change "swifter" to --swirler--.

In column 6 at lines 33, 38, 39, 40, 45, 46, and 56, in each instance change "swift" to --swirl--.

In column 6 at line 47, change"7020" to --70°--.

Signed and Sealed this

Twenty-sixth Day of August, 1997

*Attest:*

Bruce Lehman

BRUCE LEHMAN

*Attesting Officer*

*Commissioner of Patents and Trademarks*